US005749295A

United States Patent [19]

Kurz

[11] Patent Number: 5,749,295

[45] Date of Patent: May 12, 1998

[54] TEMPERATURE CONTROL DEVICE IN PRINTING MACHINES

[75] Inventor: Hans-Joachim Kurz, Grossaitingen, Germany

[73] Assignee: Baldwin-Gegenheimer GmbH, Germany

[21] Appl. No.: 505,554

[22] Filed: Jul. 21, 1995

[30] Foreign Application Priority Data

Jul. 22, 1994 [DE] Germany ..... 44 26 077.6

[51] Int. Cl.[6] ..... B41F 31/06; F28D 7/00

[52] U.S. Cl. ..... 101/350.1; 101/147; 101/487; 165/104.14

[58] Field of Search ..... 101/487, 147, 101/148, 350.1; 165/104.14, 104.19

[56] References Cited

U.S. PATENT DOCUMENTS

| | | | |
|---|---|---|---|
| 3,352,317 | 11/1967 | Dahlgren | 101/487 |
| 3,956,986 | 5/1976 | Wirz et al. | 101/148 |
| 5,189,960 | 3/1993 | Valentini et al. | 101/487 |
| 5,272,971 | 12/1993 | Fredericks | 101/136 |
| 5,375,518 | 12/1994 | Kurz | 101/216 |

FOREIGN PATENT DOCUMENTS

| | | | |
|---|---|---|---|
| 0437665 | 3/1990 | European Pat. Off. . | |
| 0553447 | 12/1992 | European Pat. Off. . | |
| 2527140 | 11/1983 | France . | |
| 1191833 | 4/1965 | Germany | 101/147 |
| 2250877 | 7/1973 | Germany . | |
| 2360611 | 7/1975 | Germany . | |
| 9314967 U | 12/1993 | Germany . | |
| 2207636 | 2/1989 | United Kingdom . | |

OTHER PUBLICATIONS

Kühle Luft für Trockenen Druck: Druckprint Aug. 1993, p. 30.

Der Trockenoffsetdruck mit MAN–Druckmaschinen: Druckweld 10/25, May 1993, pp. 37–38.

European Search Report dated Nov. 15, 1995.

*Primary Examiner*—Edgar S. Burr
*Assistant Examiner*—Daniel J. Colilla
*Attorney, Agent, or Firm*—Ostrolenk, Faber, Gerb & Soffen, LLP

[57] ABSTRACT

A temperature-control device particularly for an offset printing machine for at least two separate liquids in the machine. Dampening solution circulates in a first liquid circulation circuit to printing plates or the like receiving the dampening solution. A first heat exchanger communicates with a cold generator and the first liquid circulation circuit passes through a first heat exchanger. The second cooling solution of the printing machine cools parts of the machine and is in a second liquid circulation circuit. The second liquid circulation circuit passes through the second heat exchanger. After passing through the first heat exchanger, the first liquid circulation circuit also passes through a second heat exchanger, whereby heat is exchanged between the first and second liquid circulation circuits. The second liquid circulation circuit includes a controllable bypass for selectively bypassing the second liquid past the second exchanger. Another bypass in the first circuit selectively directs the first liquid to the printing plates or the like to which the first liquid is to be delivered or bypasses that first liquid application device. A third heat exchanger may provide cold to the second liquid circulation circuit.

20 Claims, 1 Drawing Sheet

TEMPERATURE CONTROL DEVICE IN PRINTING MACHINES

BACKGROUND OF THE INVENTION

The present invention relates to a temperature control device in printing machines for use with at least two separate liquids in a printing machine, in particular dampening solution for wet offset printing and cooling solution for an offset printing machine, and particularly relates to the cooling of and the interactions between the respective flow circuits for the two liquids in the machine.

A temperature-control device of this type in printing machines is known from EP-A-0,553,447. It includes a cold generator with a coolant circulation, and that circulation is divided into two parallel circulation branches. One circulation branch extends through a first heat exchanger and the other circulation branch extends through a second heat exchanger. Furthermore, a dampening solution circulation extends through the first heat exchanger for the purpose of exchanging heat energy with the one circulation branch of the coolant circulation. A cold water circulation extends through the second heat exchanger for the purpose of exchanging heat energy with the other circulation branch of the coolant circulation. The cold water circulation cools the cylinders of the printing machine either by flowing through the respective cylinder or by exchanging heat energy in a cold water/air heat exchanger and blowing the air cooled by the cold water onto the respective cylinder. Such printing machine cylinders can be plate cylinders, blanket cylinders, back pressure cylinders, rolls and rollers of dampening units and of inking units or other cylinders or rolls of the printing machine.

In offset printing, the dampening solution serves to dampen the non-printing zones of the printing plate of the plate cylinder so that they do not receive printing ink.

When it is started up, a printing machine often has a temperature that lies below its optimum operating temperature. In this case, the printing machine does not need to be cooled at the beginning of its operating time. However, it is desirable for the printing machine, and in particular its cylinders, rolls and rollers, to reach the optimum operating temperature as quickly as possible. Within the scope of this description, the term "cylinder" means any type of cylinder, roller and roll of a printing machine, particularly an offset printing machine.

It is known that, for dry offset printing in which the cooling of the offset printing machine takes place by cooling the ink distribution rollers, far more cold capacity is required than in wet offset printing. In offset printing machines with which dry offset or wet offset printing can take place selectively, the cold requirement for the dampening solution is zero for dry offset printing. For this reason, it is of interest to use the cold capacity, which is not required for the dampening solution and is otherwise wasted in dry offset printing, for the additionally required cold capacity of dry offset printing. The total heat requirement or total cold requirement of a printing machine is approximately of the same magnitude for wet offset printing as for dry offset printing. This total heat requirement or total cold requirement is divided approximately into 50% for the dampening solution and 50% for the ink distribution rollers of the inking unit of the printing machine.

SUMMARY OF THE INVENTION

The object of the invention is to provide a temperature control device for an offset printing machine which simply and cost effectively can be used selectively for wet offset and dry offset printing and wherein the heat capacity or cold capacity, which would be required for the dampening solution in wet offset printing, is also available for dry offset printing.

According to the invention, this object is achieved by providing respective flow circuits for the two separate liquids, a first heat exchanger for adjusting temperature in the first circuit, a second heat exchanger through which the first and second liquid circuits pass for adjusting temperature in the second circuit based on the adjustment in the first circuit in the first heat exchanger, and means in the second circuit selectively bypassing flow through the second heat exchanger for controlling temperature. The second heat exchanger follows the first one along the liquid path in the first circuit. A third heat exchanger may also be provided to control temperature in the second circuit.

The invention has the advantage that the part of the temperature control device that is required for controlling the temperature of the cold water or the cooling solution does not need to be designed for generating the full heat capacity or cold capacity of the cooling solution which is required in dry offset printing, but only for generating approximately half as much heat capacity or cooling capacity as is required for wet offset printing. In wet offset printing, the other half of the heat capacity or the cooling capacity is generated for controlling the temperature of the dampening solution. In dry offset printing, the dampening solution is not required, and the invention allows the heat capacity or cold capacity thus not required for the dampening solution to be used for dry offset printing in a simple manner.

Other objects and features of the present invention are described below with reference to the drawing.

DESCRIPTION OF THE PREFERRED EMBODIMENT

Figure 1:
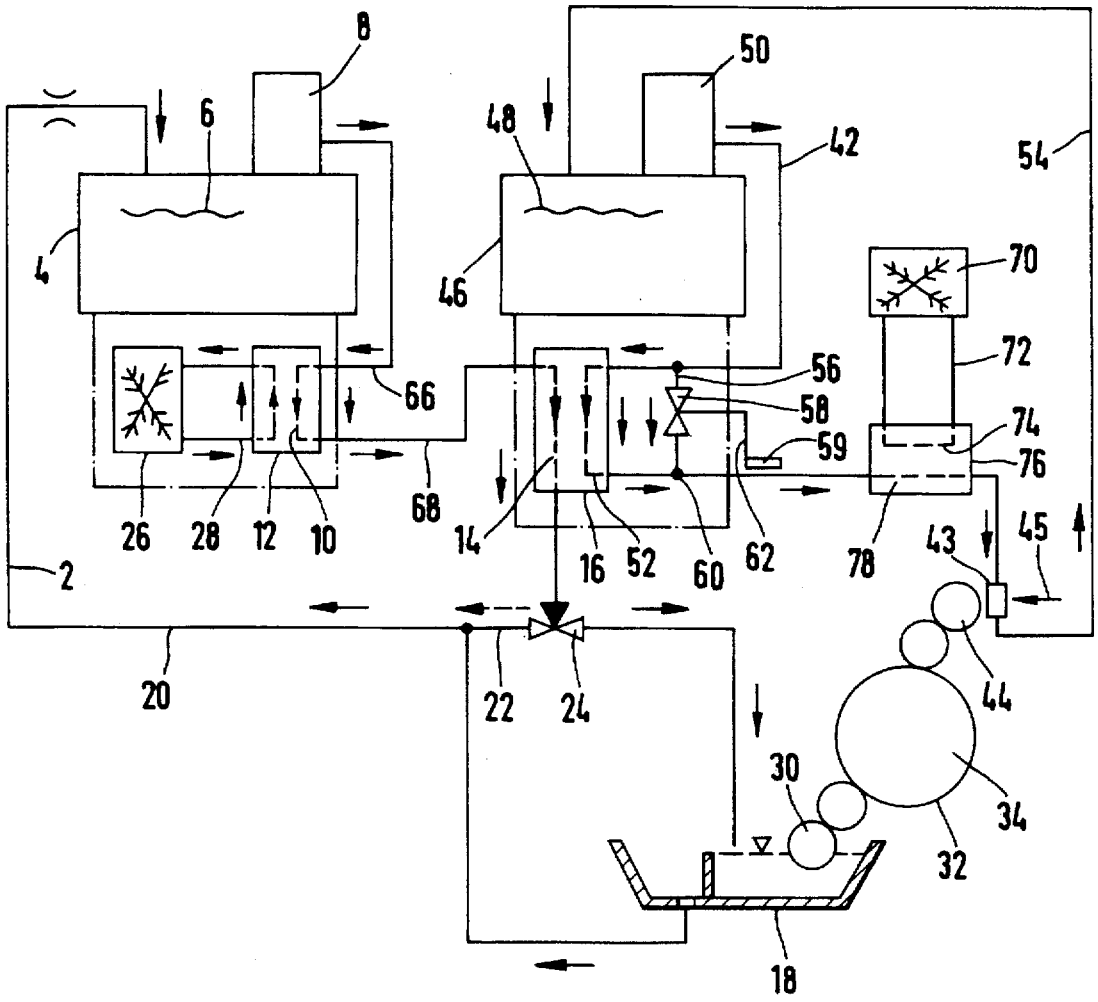
FIG. 1 diagrammatically shows a temperature-control device for use in printing machines, according to the invention.

The temperature control device according to the invention is used in printing machines to control the temperature, in particular for cooling, of two separate liquids in an offset printing machine which can be used selectively for wet offset and dry offset printing. The first liquid is dampening solution. The second liquid is cold water or a cooling solution which normally cools printing machine parts. But, when a printing machine is started up and has not yet reached the optimum operating temperature, the second liquid can also be used for heating up the printing machine.

There is a first liquid circulation circuit 2 for the dampening solution. In the flow direction, it contains successively a dampening solution container 4 in which dampening solution 6 is prepared, a pump 8 for pumping the solution in the circuit 2, a first heat exchanger section 10 in a first heat exchanger 12, a second heat exchanger section 14 in a second heat exchanger 16, a dampening solution trough 18, a return flow line 20, and a bypass 22 which bypasses the dampening solution trough 18. The bypass 22 is connected in parallel to the trough in terms of solution flow, and there is a switchover valve 24 at the upstream start of the bypass 22. The switchover valve 24 selectively conducts the dampening solution through the dampening solution trough 18 or past the trough and through the bypass 22 via the return flow line 20 and into the dampening solution container 4. In a modified embodiment, instead of a switchover valve 24, a distributor device can also be used, by which the dampening solution can be conducted partially via the dampening solution trough 18 and partially through the bypass 22.

A cold generator 26 contains a coolant circulation 28 circuit which passes through the first heat exchanger 12 and is involved in the exchange of heat energy therein with the heat exchanger section 10 of the first liquid circulation 2. In a known manner, the cold generator 26 can also compress and expand a coolant according to the compressor/evaporator principle and thus generate cold. An example of such a cold generator is described in EP-A-0,553,447.

The dampening solution container 4, the pump 8, the cold generator 26 and the first heat exchanger 12 are preferably designed as a cooling device unit for dampening solution, which unit can be treated, used and exchanged separately from the other device parts.

A part of the dampening solution is removed from the dampening solution trough 18 by rollers 30 and transferred to the printing plate 32 of a plate cylinder 34 and there serves to form ink repellent regions.

A second liquid circulation circuit 42 contains temperature control liquid, called a cooling solution in the following text, for controlling the temperature of an ink distribution roller 44 or of any other roller of an inking unit which applies printing ink to the plate cylinder 34, or for cooling the plate cylinder 34, a dampening unit roller 30, a blanket cylinder, a back pressure cylinder or any other cylinder, roll or roller of the printing machine. For this purpose, the cooling solution can either be conducted through the respective cylinder, roller or roll or it can be used for cooling air which is blown onto the respective cylinder, roll or roller. Examples of such a use of cooling solution are described in EP-A-0,553,447.

In the flow direction, the second liquid circulation circuit 42 contains, successively, a cooling solution container 46 with cooling solution 48, a pump 50, a heat exchanger section 52 which passes through the second heat exchanger 16 and exchanges heat energy with the heat exchanger section 14 of the first liquid circulation 2 inside the second heat exchanger 16, a printing machine part to undergo temperature control, for example a cooling solution/air heat exchanger 43 for blowing cooled air 45 onto the ink distributor roller 44, and a return flow line 54 which leads back to the cooling solution container 46. In a modified embodiment, the cooling solution 48 can be conducted through the ink distributor roller 44 or any other roller or roll or cylinder which has to undergo temperature control instead of or in addition to the cooling solution/air heat exchanger 43.

A controllable bypass 56 in the second liquid circulation 42 bypasses the second heat exchanger 16. A throughflow adjustment element in the form of a throughflow control valve 58 is located in the bypass 56. It is controlled or regulated by hand or automatically depending on the temperature, for adjusting a part of the second liquid 48 flowing through the bypass 56. The throughflow control valve 58 allows between 0% and 100% of the cooling solution 48 to flow through the bypass 56, 100% to 0% of the cooling solution then correspondingly flowing through the second heat exchanger 16. The throughflow control valve 58 is controlled as a function of the temperature which is measured by a temperature sensor 59 located directly downstream of the point 60 where the downstream sides of the bypass 56 and of the heat exchanger section 52 passing through the second heat exchanger 16 are joined together. As a function of the temperature measured, the temperature sensor 59 transmits a corresponding signal for the actual temperature value via a line 62 to the throughflow control valve 58 which, as a function of this actual value and a given temperature reference value, controls the throughflow through the bypass 56.

The cooling solution container 46, the second heat exchanger 16, the bypass 56 and the temperature sensor 59 are preferably combined to form a separate construction unit which is releasably connected in terms of flow to connection lines 66 and 68 of the first heat exchanger 12 for the first liquid circulation circuit 2.

According to a particular design of the temperature control device, a second cold generator 70 with a coolant circulation 72 may be provided. It has a heat exchanger section 74 in a third heat exchanger 76 and is involved in the exchange of heat energy therein with a heat exchanger section 78 of the second liquid circulation 42. The third heat exchanger 76 is preferably located in the section of the second liquid circulation circuit 42 which connects the downstream side of the second liquid circulation circuit 42 at the second heat exchanger 16 in terms of flow to the printing machine element 44 to be cooled. By using a second cold generator 70 and a third heat exchanger 76, additional cold can be generated for cooling the printing machine, if that is required for dry offset printing, without the first cold generator 26 needing to be larger than is required for wet offset printing.

By means of the bypass 56 in the second liquid circulation circuit 42, the temperature of the cooling liquid 48 flowing through the circuit 42 can be adjusted or controlled. The more cooling liquid 48 that flows through the bypass 56 instead of through the second heat exchanger 16, the less the liquid 48 is cooled by the first liquid circulation 2.

The arrows next to the liquid lines indicate the flow direction of the liquids therein.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A temperature control device for controlling the temperatures of at least two separate liquids in a printing machine, the device comprising:

a first liquid circulation circuit for the first liquid for circulating the first liquid to first means in the printing machine for applying the first liquid;

a first heat exchanger through which the first liquid circulation circuit passes; a cold generator including a coolant circulation circuit passing through the first heat exchanger for the exchange of heat energy between the coolant circulation circuit of the cold generator and the first liquid circulation circuit;

a second liquid circulation circuit for a second liquid, for transmitting the second liquid to second means in the printing machine for using the second liquid;

a second heat exchanger; the second liquid circulation circuit passing through the second heat exchanger; the first liquid circulation circuit also passing through the second heat exchanger, whereby the second liquid circulation circuit exchanges heat energy with the first liquid circulation circuit in the second heat exchanger.

2. The temperature control device of claim 1, further comprising a second cold generator including a respective third coolant circulation circuit and a respective third heat exchanger; and the second liquid circulation circuit passing through the third heat exchanger.

3. The temperature control device of claim 1, further comprising a first pump in the first liquid circulation circuit for pumping the first liquid through the first liquidation circuit; and a second pump in the second liquid circulation circuit for pumping the second liquid through the second circulation circuit.

4. The temperature control device of claim 1, wherein the printing machine is an offset printing machine capable of wet offset printing, the first liquid comprises dampening solution for wet offset printing, and the second liquid comprising cooling solution of the offset printing machine.

5. The temperature control device of claim 4, further comprising:

a valve in the first liquid circulation circuit downstream from both of the first and second heat exchangers along the path of the first liquid through the first liquid circulation circuit;

a bypass in the first liquid circulation circuit past the first means for applying the first liquid, the valve in the first circuit being adjustable to selectively conduct liquid through the first circuit to the first means for applying the liquid or for conducting the first liquid past the first means through the bypass.

6. The temperature control device of claim 1, wherein the first liquid is dampening solution for a printing plate of a plate cylinder in wet offset printing in the printing machine and wherein the second liquid is a cooling solution for controlling the temperature of parts of the printing machine.

7. The temperature control device of claim 1, wherein the first and second heat exchangers are located along the first liquid circulation circuit so that the first liquid circulation circuit passes the first heat exchanger and then passes the second heat exchanger in the flow direction of the first liquid.

8. The temperature control device of claim 7, further comprising:

a second controllable bypass at the second liquid circulation circuit for bypassing the second liquid in the second liquid circulation circuit past the second heat exchanger;

a throughflow adjustment element for the second controllable bypass for selecting the quantity of the second liquid in the second liquid circulation circuit which flows through the bypass and thereby selecting the quantity of the second liquid which flows through the second heat exchanger.

9. The temperature control device of claims 8, wherein the throughflow adjustment element is an automatic element operable dependent upon the temperature at least of the second liquid in the second liquid circulation circuit for adjusting the portion of the second liquid flowing through the second bypass.

10. The temperature control device of claim 7, further comprising a second cold generator including a respective third coolant circulation circuit and a respective third heat exchanger; and the second liquid circulation circuit passing through the third heat exchanger.

11. The temperature control device of claim 7, wherein the second heat exchanger and a portion of the second liquid circulation circuit generally at the second heat exchanger are combined as to form a separate construction unit which is so connected to the first liquid circulation circuit so as to be releasable and separable from the first liquid circulation circuit.

12. The temperature control device of claim 7, further comprising:

a valve in the first liquid circulation circuit downstream from both of the first and the second heat exchangers along the path of the first liquid through the first liquid circulation circuit;

a bypass in the first liquid circulation circuit past the first means for applying the first liquid; the valve in the first circuit being adjustable to selectively conduct liquid through the first circuit to the first means for applying the liquid or for conducting the first liquid past the first means through the bypass.

13. The temperature control device of claim 12, wherein the first means for applying the first liquid is connected with the printing machine so as to bring about temperature control or dampening of a part of the printing machine.

14. The temperature control device of claim 12, further comprising:

a second controllable bypass at the second liquid circulation circuit for bypassing the second liquid in the second liquid circulation circuit past the second heat exchanger;

a throughflow adjustment element for the second controllable bypass for selecting the quantity of the second liquid in the second liquid circulation circuit which flows through the bypass and thereby selecting the quantity of the second liquid which flows through the second heat exchanger.

15. The temperature control device of claim 14, wherein the first liquid is dampening solution for a printing plate of a plate cylinder in wet offset printing in the printing machine and wherein the second liquid is a cooling solution for controlling the temperature of parts of the printing machine.

16. In combination, the temperature control device of claim 15 with a printing machine, wherein the temperature sensor is used on the printing machine and wherein the printing machine includes printing plates of a plate cylinder in wet offset printing, wherein the means for applying the first liquid comprises means for applying the dampening solution to the printing plates during wet offset printing; the printing machine comprising parts including inking unit rollers, dampening unit rollers, pressure cylinder.

17. The temperature control device of claim 14, further comprising a temperature sensor for sensing the temperature in the second liquid circulation circuit and the temperature sensor being connected with the throughflow adjustment element so that the operation of the throughflow adjustment element is controlled or regulated as a function of a temperature in the second liquid circulation circuit.

18. The temperature control device of claim 14, further comprising a second cold generator including a respective third coolant circulation circuit and a respective third heat exchanger; and the second liquidation circuit passing through the third heat exchanger.

19. A temperature control device for an offset printing machine for controlling the temperature of at least two separate liquids in the printing machine, the device comprising:

a respective first and second circuit for each of the first and second liquids; a first heat exchanger through which the first circuit passes for adjusting temperature of the liquid in the first circuit;

a respective second heat exchanger through which both of the first and the second liquid circuits pass for adjusting the temperature in the second circuit based at least partially on the temperature in the first circuit;

and means in the second circuit for selectively bypassing flow away from or through the second heat exchanger for controlling temperature of the liquid in the second circuit.

20. The temperature control device of claim 19, wherein the second heat exchanger follows the first heat exchanger along the path of the liquid through the first circuit.

* * * * *